US010787340B2

(12) United States Patent
Ginsberg et al.

(10) Patent No.: US 10,787,340 B2
(45) Date of Patent: Sep. 29, 2020

(54) SENSOR AND DRIVE MOTOR LEARN RUN FOR ELEVATOR SYSTEMS

(71) Applicant: Otis Elevator Company, Farmington, CT (US)

(72) Inventors: David Ginsberg, Granby, CT (US); Shashank Krishnamurthy, Glastonbury, CT (US); Lei Xing, South Windsor, CT (US); Penghe Geng, Vernon, CT (US); Ankit Anand Gupta, Mysore (IN); Yogesh Parmod Jadhav, Mysore (IN); Basavanagouda Goudra, Mysore (IN); Pramod Mandikal Gurukumar, Mysore (IN)

(73) Assignee: OTIS ELEVATOR COMPANY, Farmington, CT (US)

( * ) Notice: Subject to any disclaimer, the term of this patent is extended or adjusted under 35 U.S.C. 154(b) by 489 days.

(21) Appl. No.: 15/619,871

(22) Filed: Jun. 12, 2017

(65) Prior Publication Data

US 2017/0355555 A1 Dec. 14, 2017

(30) Foreign Application Priority Data

Jun. 13, 2016 (IN) ..... 201611020113

(51) Int. Cl.

| | |
|---|---|
| ***B66B 1/34*** | (2006.01) |
| ***B66B 1/40*** | (2006.01) |
| ***B66B 1/24*** | (2006.01) |

(52) U.S. Cl.

CPC ..... *B66B 1/3492* (2013.01); *B66B 1/40* (2013.01); *B66B 1/2433* (2013.01)

(58) Field of Classification Search

CPC ..... B66B 1/3492; B66B 1/40; B66B 1/2433

(Continued)

(56) References Cited

U.S. PATENT DOCUMENTS 5,883,344 A 3/1999 Colby et al.
5,929,400 A 7/1999 Colby et al.

(Continued)

FOREIGN PATENT DOCUMENTS

CN 1221250 A 6/1999
CN 1222006 A 7/1999

(Continued)

OTHER PUBLICATIONS

Huang, S.N. et al., "Adaptive Precision Control of Permanent Magnet Linear Motors", Asian Journal of Control, vol. 4, No. 2, pp. 193-198, Jun. 2002, pp. 193-198.

(Continued)

*Primary Examiner* — Jeffrey Donels

(74) *Attorney, Agent, or Firm* — Cantor Colburn LLP

(57) ABSTRACT

A method of operating an elevator system for a learn run sequence including the steps of moving, using a linear propulsion system, an elevator car through a lane of an elevator shaft at a selected velocity; detecting, using a sensor system, the location of the elevator car when it moves through the lane; controlling, using a control system, the elevator car, the control system being in operable communication with the elevator car, the linear propulsion system, and the sensor system; and determining, using the control system, a location of each of the car state sensors relative to each other within the lane in response to at least one of a travel time of the elevator car, a velocity of the elevator car, a position of the elevator car, and a height of the elevator car.

16 Claims, 6 Drawing Sheets

(58) Field of Classification Search
USPC ..... 187/247
See application file for complete search history.

(56) References Cited

U.S. PATENT DOCUMENTS

| | | | | |
|---|---|---|---|---|
| 6,281,659 | B1 | 8/2001 | Giuseppe | |
| 6,285,961 | B1 | 9/2001 | Jahkonen et al. | |
| 7,073,633 | B2 | 7/2006 | Weinberger et al. | |
| 7,385,363 | B2 | 6/2008 | Schemm | |
| 7,786,685 | B2 | 8/2010 | Schueren | |
| 2003/0217893 | A1* | 11/2003 | Dunser | B66B 1/2466 187/249 |
| 2017/0088393 | A1* | 3/2017 | Jacobs | B66B 1/24 |
| 2017/0088395 | A1* | 3/2017 | Roberts | B66B 1/2491 |

FOREIGN PATENT DOCUMENTS

| | | | |
|---|---|---|---|
| CN | 202818219 | U | 3/2013 |
| CN | 103338001 | A1 | 10/2013 |
| EP | 2522612 | A1 | 11/2012 |
| WO | 2015022056 | A1 | 2/2015 |
| WO | 2015144989 | A1 | 10/2015 |
| WO | 2016055630 | A1 | 4/2016 |

OTHER PUBLICATIONS

Khambadkone, A.M. et al., "Vector-controlled induction motor drive with a selfcommissioning scheme" abstract, IEEE Transactions on Industrial Electronics ( vol. 38, Issue: 5, Oct. 1991 ), 2pgs.
Kudor, T. et al., "Self-commissioning for vector controlled induction motors", abstract, Industry Applications Society Annual Meeting, 1993., Conference Record of the 1993 IEEE, 2pgs.
Otten, Gerco et al., "Linear Motor Motion Control Using a Learning Feedforward Controller", IEEE/ASME Transactions on Mechatronics, vol. 2, No. 3, Sep. 1997, pp. 179-187.
Chinese First Office Action dated Apr. 23, 2020 for Application No. 201710440635.7; 7 pages.

* cited by examiner

160a
$P_{i+1}$
160b
$P_i$
160c
$P_{i-1}$
164
H1
$t_{i-1t}$
114
184
110

160a
$P_{i+1}$
160b
$P_i$
160c
$P_{i-1}$
164
184
$t_{ib}$
114
110

SENSOR AND DRIVE MOTOR LEARN RUN FOR ELEVATOR SYSTEMS

PRIORITY

This application claims priority to Indian Provisional Patent Application No. 201611020113, filed Jun. 13, 2017, and all the benefits accruing therefrom under 35 U.S.C. § 119, the contents of which in its entirety are herein incorporated by reference.

BACKGROUND

The subject matter disclosed herein generally relates to the field of elevators, and more particularly to a sensor and drive motor segment location determination within an elevator system.

Ropeless elevator systems, also referred to as self-propelled elevator systems, are useful in certain applications (e.g., high rise buildings) where the mass of the ropes for a roped system is prohibitive and there is a desire for multiple elevator cars to travel in a single hoistway, elevator shaft, or lane. There exist conceptually ropeless elevator systems in which a first lane is designated for upward traveling elevator cars and a second lane is designated for downward traveling elevator cars. A transfer station at each end of the lane is used to move cars horizontally between the first lane and second lane. Multi-car ropeless elevator systems can require a large number of sensors and drive motor segments to operate, which often complicates and lengthens an installation process.

BRIEF SUMMARY

According to one embodiment, a method of operating an elevator system for a learn run sequence is provided. The method including the steps of moving, using a linear propulsion system, an elevator car through a lane of an elevator shaft at a selected velocity. The linear propulsion system including: a first part mounted in the lane of the elevator shaft; and a second part mounted to the elevator car, the second part being configured to co-act with the first part to impart movement to the elevator car. The method also including the steps of: detecting, using a sensor system, the location of the elevator car when it moves through the lane. The sensor system including; a plurality of sensed elements disposed on the elevator car; and a plurality of car state sensors disposed within the lane, the plurality of car state sensors being configured to detect the sensed element when the elevator car is in proximity to the respective car state sensor. The method further includes the steps of: controlling, using a control system, the elevator car, the control system being in operable communication with the elevator car, the linear propulsion system, and the sensor system; and determining, using the control system, a location of each of the car state sensors relative to each other within the lane in response to at least one of a travel time of the elevator car, a velocity of the elevator car, a position of the elevator car, and a height of the elevator car.

In addition to one or more of the features described above, or as an alternative, further embodiments of the method may include that the first part includes one or more motor segments and one or more associated drives; and the second part includes one or more permanent magnets.

In addition to one or more of the features described above, or as an alternative, further embodiments of the method may include determining, using the control system, at least one of the location, the length, and the phasing of each of the one or more motor segments in response to a back electromotive force of the motor segments.

In addition to one or more of the features described above, or as an alternative, further embodiments of the method may include configuring each of the drives in response to the location of the motor segment.

In addition to one or more of the features described above, or as an alternative, further embodiments of the method may include that the elevator car is a first elevator car. The system further includes a second elevator car disposed in the same lane of the elevator shaft as the first elevator car. The plurality of car state sensors are configured to determine a location of each the first elevator car and the second elevator car.

In addition to one or more of the features described above, or as an alternative, further embodiments of the method may include that the plurality of car state sensors define a plurality of first car state sensors disposed with a first lane and the elevator car is a first elevator car in the first lane. The system further including: a second elevator car disposed in a second lane of the elevator shaft; and a plurality of second car state sensors disposed within the second lane configured to determine a location of the second elevator car.

In addition to one or more of the features described above, or as an alternative, further embodiments of the method may include that the elevator system is a multicar, ropeless elevator system.

According to another embodiment, an elevator system is provided. The system including: a processor; a memory including computer-executable instructions that, when executed by the processor, cause the processor to perform operations. The operations including the steps of: moving, using a linear propulsion system, an elevator car through a lane of an elevator shaft at a selected velocity. The linear propulsion system including: a first part mounted in the lane of the elevator shaft; and a second part mounted to the elevator car, the second part being configured to co-act with the first part to impart movement to the elevator car. The operations also include the step of detecting, using a sensor system, the location of the elevator car when it moves through the lane. The sensor system including; a plurality of sensed elements disposed on the elevator car; and a plurality of car state sensors disposed within the lane, the plurality of car state sensors being configured to detect the sensed element when the elevator car is in proximity to the respective car state sensor. The operations further including the steps of: controlling, using a control system, the elevator car, the control system being in operable communication with the elevator car, the linear propulsion system, and the sensor system; and determining, using the control system, a location of each of the car state sensors relative to each other within the lane in response to at least one of a travel time of the elevator car, a velocity of the elevator car, a position of the elevator car, and a height of the elevator car.

In addition to one or more of the features described above, or as an alternative, further embodiments of the system may include that the first part includes one or more motor segments and one or more associated drives; and the second part includes one or more permanent magnets.

In addition to one or more of the features described above, or as an alternative, further embodiments of the system may include that the operations further include: determining, using the control system, at least one of the location, the length, and the phasing of each of the one or more motor segments in response to a back electromotive force of the motor segments.

In addition to one or more of the features described above, or as an alternative, further embodiments of the system may include that the operations further include: configuring each of the drives in response to the location of the motor segment.

In addition to one or more of the features described above, or as an alternative, further embodiments of the system may include that the elevator car is a first elevator car, the system further includes: a second elevator car disposed in the same lane of the elevator shaft as the first elevator car, the plurality of car state sensors are configured to determine a location of each the first elevator car and the second elevator car.

In addition to one or more of the features described above, or as an alternative, further embodiments of the system may include that the plurality of car state sensors define a plurality of first car state sensors disposed with a first lane and the elevator car is a first elevator car in the first lane, the system further includes: a second elevator car disposed in a second lane of the elevator shaft; and a plurality of second car state sensors disposed within the second lane configured to determine a location of the second elevator car.

In addition to one or more of the features described above, or as an alternative, further embodiments of the system may include that the elevator system is a multicar, ropeless elevator system.

According to another embodiment, a computer program product tangibly embodied on a computer readable medium is provided. The computer program product including instructions that, when executed by a processor, cause the processor to perform operations. The operations including: moving, using a linear propulsion system, an elevator car through a lane of an elevator shaft at a selected velocity. The linear propulsion system including: a first part mounted in the lane of the elevator shaft; and a second part mounted to the elevator car, the second part being configured to co-act with the first part to impart movement to the elevator car. The operations also include: detecting, using a sensor system, the location of the elevator car when it moves through the lane. The sensor system including: a plurality of sensed elements disposed on the elevator car; and a plurality of car state sensors disposed within the lane. The plurality of car state sensors being configured to detect the sensed element when the elevator car is in proximity to the respective car state sensor. The operations further include: controlling, using a control system, the elevator car, the control system being in operable communication with the elevator car, the linear propulsion system, and the sensor system; and determining, using the control system, a location of each of the car state sensors relative to each other within the lane in response to a travel time of the elevator car, a velocity of the elevator car, a position of the elevator car, and a height of the elevator car.

In addition to one or more of the features described above, or as an alternative, further embodiments of the computer program may include that the first part includes one or more motor segments and one or more associated drives; and the second part includes one or more permanent magnets.

In addition to one or more of the features described above, or as an alternative, further embodiments of the computer program may include that the operations further include: determining, using the control system, at least one of the location, the length, and the phasing of each of the one or more motor segments in response to a back electromotive force of the motor segments.

In addition to one or more of the features described above, or as an alternative, further embodiments of the computer program may include that the operations further include: configuring each of the drives in response to the location of the motor segment.

In addition to one or more of the features described above, or as an alternative, further embodiments of the computer program may include that the elevator car is a first elevator car, the system further including a second elevator car disposed in the same lane of the elevator shaft as the first elevator car, the plurality of car state sensors are configured to determine a location of each the first elevator car and the second elevator car.

In addition to one or more of the features described above, or as an alternative, further embodiments of the computer program may include that the plurality of car state sensors define a plurality of first car state sensors disposed with a first lane and the elevator car is a first elevator car in the first lane. The system further including: a second elevator car disposed in a second lane of the elevator shaft; and a plurality of second car state sensors disposed within the second lane configured to determine a location of the second elevator car.

Technical effects of embodiments of the present disclosure include a learn run sequence for determining the location of sensors and drive motor segment determination within elevator system. Further technical embodiments include utilizing a learn run sequence for configuring the drive control system within an elevator system.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The foregoing and other features, and advantages of the disclosure are apparent from the following detailed description taken in conjunction with the accompanying drawings in which like elements are numbered alike in the several FIGURES.

DETAILED DESCRIPTION

Figure 1:
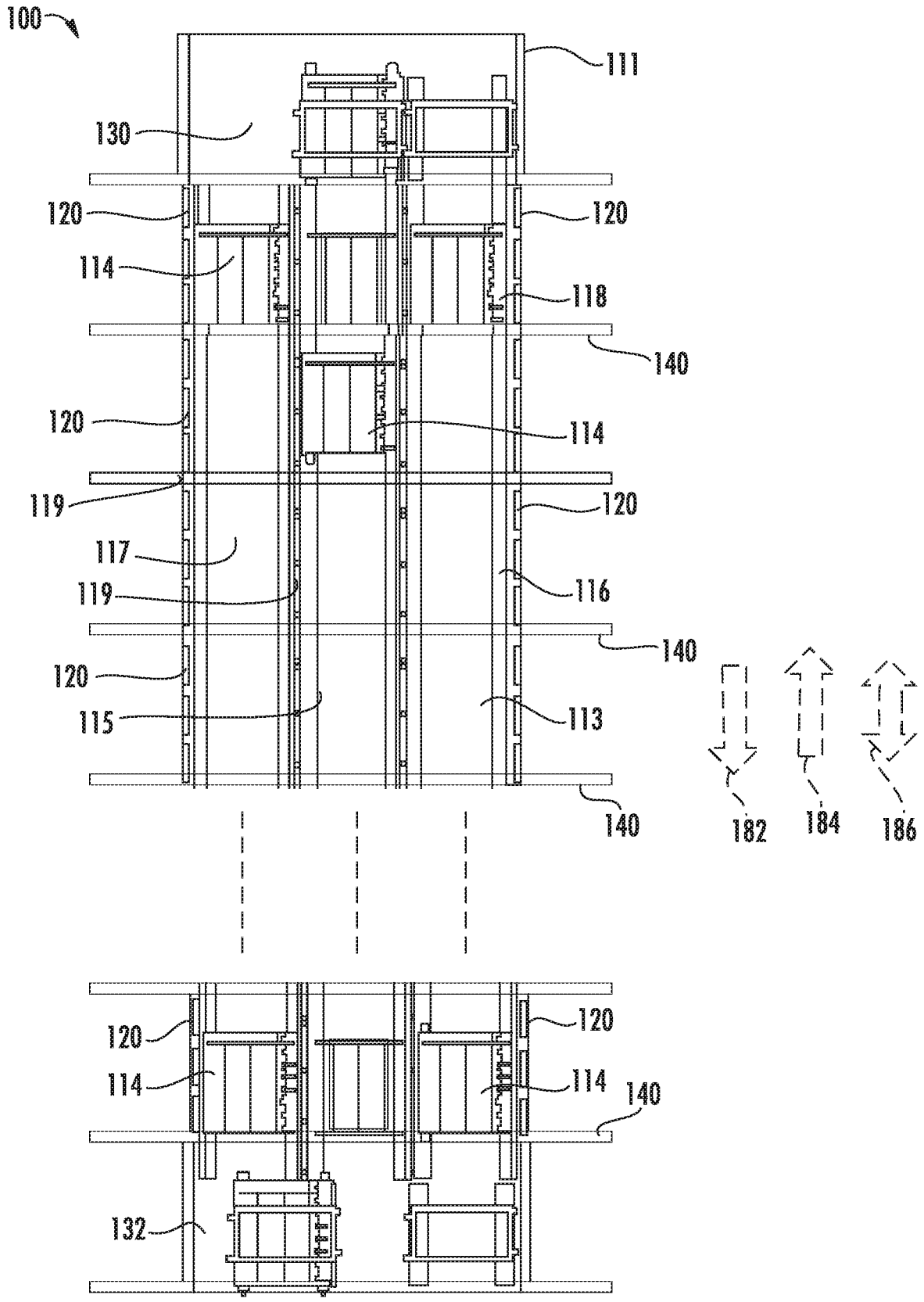
FIG. 1 illustrates a schematic view of a multicar elevator system, in accordance with an embodiment of the disclosure.

FIG. 1 depicts a multicar, ropeless elevator system 100 that may be employed with embodiments of the present disclosure. The ropeless elevator system 100 includes an elevator shaft 111 having a plurality of lanes 113, 115 and 117. While three lanes 113, 115, 117 are shown in FIG. 1, it is understood that various embodiments of the present disclosure and various configurations of a multicar, ropeless elevator system may include any number of lanes, either more or fewer than the three lanes shown in FIG. 1. In each lane 113, 115, 117, multiple elevator cars 114 can travel in one direction, i.e., up as shown by arrow 184 or down as shown by arrow 182, or multiple cars within a single lane may be configured to move in opposite directions, as shown by arrow 186. For example, in FIG. 1 elevator cars 114 in lanes 113 and 115 travel up in the direction of arrow 184 and elevator cars 114 in lane 117 travel down in the direction of arrow 182. Further, as shown in FIG. 1, one or more elevator cars 114 may travel in a single lane 113, 115, and 117.

As shown, above the top accessible floor of the building is an upper transfer station 130 configured to impart horizontal motion to the elevator cars 114 to move the elevator cars 114 between lanes 113, 115, and 117. It is understood that upper transfer station 130 may be located at the top floor, rather than above the top floor. Similarly, below the first floor of the building is a lower transfer station 132 configured to impart horizontal motion to the elevator cars 114 to move the elevator cars 114 between lanes 113, 115, and 117. It is understood that lower transfer station 132 may be located on the first floor, rather than below the first floor. Although not shown in FIG. 1, one or more intermediate transfer stations may be configured between the lower transfer station 132 and the upper transfer station 130. Intermediate transfer stations are similar to the upper transfer station 130 and lower transfer station 132 and are configured to impart horizontal motion to the elevator cars 114 at the respective transfer station, thus enabling transfer from one lane to another lane at an intermediary point within the elevator shaft 111. Further, although not shown in FIG. 1, the elevator cars 114 are configured to stop at a plurality of floors 140 to allow ingress to and egress from the elevator cars 114.

Elevator cars 114 are propelled within lanes 113, 115, 117 using a propulsion system such as a linear, permanent magnet motor system having a primary, fixed portion, or first part 116, and a secondary, moving portion, or second part 118. The first part 116 is a fixed part because it is mounted to a portion of the lane, and the second part 118 is a moving part because it is mounted on the elevator car 114 that is movable within the lane.

The first part 116 includes windings or coils mounted on a structural member 119, and may be mounted at one or both sides of the lanes 113, 115, and 117, relative to the elevator cars 114. Specifically, first parts 116 will be located within the lanes 113, 115, 117, on walls or sides that do not include elevator doors.

The second part 118 includes permanent magnets mounted to one or both sides of cars 114, i.e., on the same sides as the first part 116. The second part 118 engages with the first part 116 to support and drive the elevators cars 114 within the lanes 113, 115, 117. First part 116 is supplied with drive signals from one or more drive units 120 to control movement of elevator cars 114 in their respective lanes through the linear, permanent magnet motor system. The second part 118 operatively connects with and electromagnetically operates with the first part 116 to be driven by the signals and electrical power. The driven second part 118 enables the elevator cars 114 to move along the first part 116 and thus move within a lane 113, 115, and 117.

Those of skill in the art will appreciate that the first part 116 and second part 118 are not limited to this example. In alternative embodiments, the first part 116 may be configured as permanent magnets, and the second part 118 may be configured as windings or coils. Further, those of skill in the art will appreciate that other types of propulsion may be used without departing from the scope of the present disclosure. For example, other linear motors may be utilized including any combination of synchronous, induction, homopolar, and piezo electric motors.

The first part 116, as shown in FIG. 1, is formed from a plurality of motor segments 122 (Seen in FIG. 2), with each segment associated with a drive unit 120. Although not shown, the central lane 115 of FIG. 1 also includes a drive unit for each segment of the first part 116 that is within the lane 115. Those of skill in the art will appreciate that although a drive unit 120 is provided for each motor segment 122 (Seen in FIG. 2) of the system (one-to-one) other configurations may be used without departing from the scope of the present disclosure. Further, those of skill in the art will appreciate that other types of propulsion may be employed without departing from the scope of the present disclosure. For example, a magnetic screw may be used for a propulsion system of elevator cars. Thus, the described and shown propulsion system of this disclosure is merely provided for explanatory purposes, and is not intended to be limiting.

Figure 2:
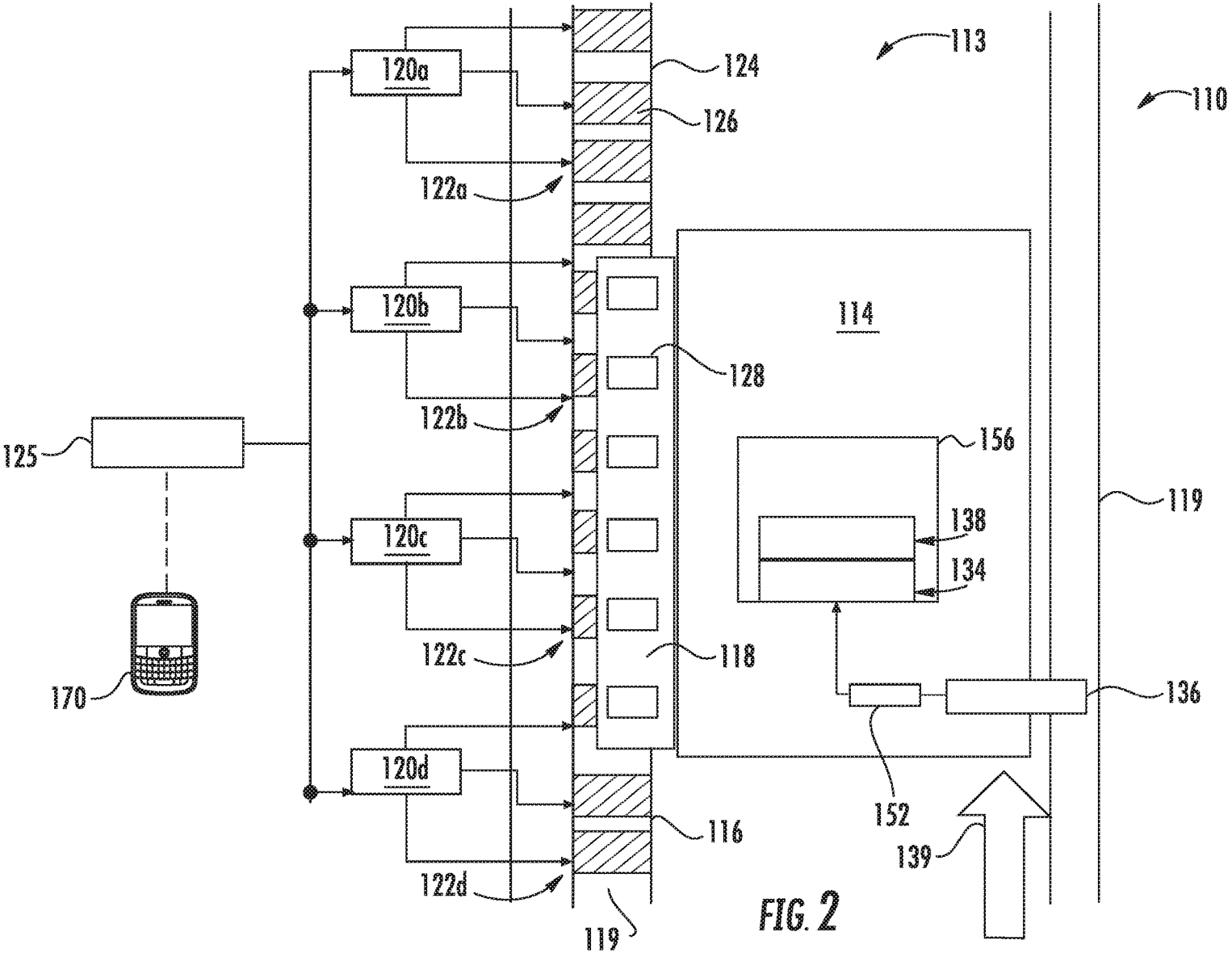
FIG. 2 illustrates an enlarged schematic view of a single elevator car within the multicar elevator system of FIG. 1, in accordance with an embodiment of the disclosure.

Turning now to FIG. 2, a view of an elevator system 110 including an elevator car 114 that travels in lane 113 is shown. Elevator car 114 is guided by one or more guide rails 124 extending along the length of lane 113, where the guide rails 124 may be affixed to a structural member 119. For ease of illustration, the view of FIG. 2 only depicts a single guide rail 124; however, there may be any number of guide rails positioned within the lane 113 and may, for example, be positioned on opposite sides of the elevator car 114. Elevator system 110 employs a linear propulsion system as described above, where a first part 116 includes multiple motor segments 122*a*, 122*b*, 122*c*, 122*d* each with one or more coils 126 (i.e., phase windings). The first part 116 may be mounted to guide rail 124, incorporated into the guide rail 124, or may be located apart from guide rail 124 on structural member 119. The first part 116 serves as a stator of a permanent magnet synchronous linear motor to impart force to elevator car 114. The second part 118, as shown in FIG. 2, is mounted to the elevator car 114 and includes an array of one or more permanent magnets 128 to form a second portion of the linear propulsion system of the ropeless elevator system. Coils 126 of motor segments 122*a*, 122*b*, 122*c*, 122*d* may be arranged in one or more phases, as is known in the electric motor art, e.g., three, six, etc. One or more first parts 116 may be mounted in the lane 113, to co-act with permanent magnets 128 mounted to elevator car 114. Although only a single side of elevator car 114 is shown with permanent magnets 128 the example of FIG. 2, the permanent magnets 128 may be positioned on two or more sides of elevator car 114. Alternate embodiments may use a single first part 116/second part 118 configuration, or multiple first part 116/second part 118 configurations.

In the example of FIG. 2, there are four motor segments 122*a*, 122*b*, 122*c*, 122*d* depicted. Each of the motor segments 122*a*, 122*b*, 122*c*, 122*d* has a corresponding or associated drive 120*a*, 120*b*, 120*c*, 120*d*. A system controller 125 provides command signals to the drive 120*a*, 120*b*, 120*c*, 120*d*, which are used to calculate the drive signals sent to the motor segments 122*a*, 122*b*, 122*c*, 122*d* via drives 120*a*, 120*b*, 120*c*, 120*d* to control motion of the elevator car 114. The system controller 125 may be implemented using a microprocessor executing a computer program stored on a storage medium to perform the operations described herein. Alternatively, the system controller 125 may be implemented in hardware (e.g., ASIC, FPGA) or in a combination of hardware/software. The system controller 125 may also be part of an elevator control system. The system controller 125 may include power circuitry (e.g., an inverter or drive) to power the first part 116. Although a single system controller 125 is depicted, it will be understood by those of ordinary skill in the art that a plurality of system controllers may be used. For example, a single system controller may be provided to control the operation of a group of motor segments over a relatively short distance, and in some embodiments a single system controller may be provided for each drive unit or group of drive units, with the system controllers in communication with each other.

In some embodiments, as shown in FIG. 2, the elevator car 114 includes an on-board controller 156 with one or more transceivers 138 and a processor, or CPU, 134. The on-board controller 156 and the system controller 125 collectively form a control system where computational processing may be shifted between the on-board controller 156 and the system controller 125.

The controller system may include at least one processor and at least one associated memory comprising computer-executable instructions that, when executed by the processor, cause the processor to perform various operations. The processor may be but is not limited to a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory may be a storage device such as, for example, a random access memory (RAM), read only memory (ROM), or other electronic, optical, magnetic or any other computer readable medium.

In some embodiments, the processor 134 of on-board controller 156 is configured to monitor one or more sensors and to communicate with one or more system controllers 125 via the transceivers 138. In some embodiments, to ensure reliable communication, elevator car 114 may include at least two transceivers 138 configured for redundancy of communication. The transceivers 138 can be set to operate at different frequencies, or communication channels, to minimize interference and to provide full duplex communication between the elevator car 114 and the one or more system controllers 125. In the example of FIG. 2, the on-board controller 156 may interface with a load sensor 152 to detect an elevator load on a brake 136. The brake 136 may engage with the structural member 119, a guide rail 124, or other structure in the lane 113. Although the example of FIG. 2 depicts only a single load sensor 152 and brake 136, elevator car 114 can include multiple load sensors 152 and brakes 136.

In an embodiment, the ropeless elevator system 100 may include a configuration system 170 operatively connected to the control system (controller 125 and on-board controller 156). The configuration system 170 may be part of the control system or temporarily attached. The configuration system 170 configures each of the motor segments 122*a*, 122*b*, 122*c* through a learn run sequence and associated configuration process that is performed, after the ropeless elevator system 100 has been physically installed. The configuration system 170 may be an interface device such as, for example, an elevator operational panel, an elevator supervisory panel, a cellular phone, tablet, laptop, smartwatch, desktop computer or any similar device known to one of skill in the art. The configuration system 170 may be operatively connected to the control system via a hard wire or wirelessly through a wireless transmission method such as, for example, radio, microwave, cellular, satellite, or another wireless communication method.

In order to drive the elevator car 114, one or more motor segments 122*a*, 122*b*, 122*c*, 122*d* can be configured to overlap the second part 118 of the elevator car 114 at any given point in time. In the example of FIG. 2, motor segment 122*d* partially overlaps the second part 118 (e.g., about 33% overlap), motor segment 122*c* fully overlaps the second part 118 (100% overlap), and motor segment 122*d* partially overlaps the second part 118 (e.g., about 66% overlap). There is no depicted overlap between motor segment 122*a* and the second part 118. In some embodiments, the control system (system controller 125 and on-board controller 156) is operable to apply an electrical current to at least one of the motor segments 122*b*, 122*c*, 122*d* that overlaps the second part 118. The system controller 125 may control the electrical current on one or more of the drive units 120*a*, 120*b*, 120*c*, 120*d* while receiving data from the on-board controller 156 via transceiver 138 based on a variety of sensors of the elevator system 110 including but not limited to load sensor 152 and sensors 160*a*, 160*b*, 160*c*. The electrical current may apply an upward thrust force 139 to the elevator car 114 by injecting a current, thus propelling the elevator car 114 within the lane 113. The current may be controlled via feedback control to ensure the current remains constant within a selected tolerance. The thrust produced by each motor segment 122*b*, 122*c*, 122*d* is dependent, in part, on the amount of overlap between the first part 116 with the second part 118. The peak thrust is obtained for each motor segment 122*b*, 122*c*, 122*d* when there is maximum overlap of the first part 116 and the secondary portion 118.

In traditional rotary drive, roped, elevator systems, the position of the elevator car could be determined accurately by a rotary encoder or similar device that measured the rotation of a rotor or spool and could determine the position of the car based on the amount/length of rope that was deployed. However, ropeless elevator systems void the applicability for rotary encoder and rotary motors as no rope or rotor is used.

Figure 3:
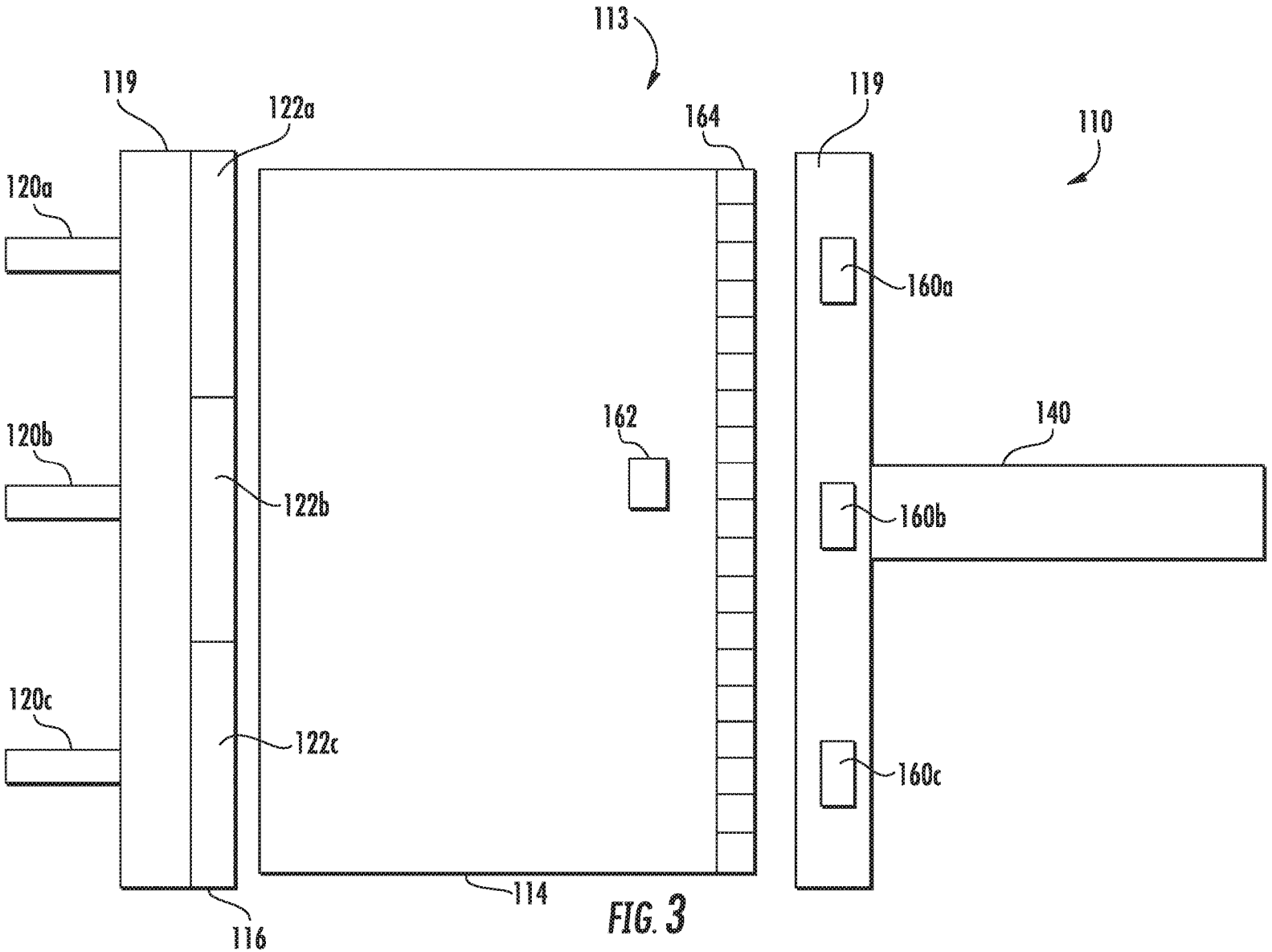
FIG. 3 illustrates an enlarge schematic view of a the single elevator car of FIG. 2 having a sensing system, in accordance with an embodiment of the disclosure.

Turning now to FIG. 3, a schematic view of a first embodiment of the sensing system of the present disclosure is shown. Car 114 is located within a lane 113 and configured to move in an upward or downward direction, depending on the control signals provided by drive units 120*a*, 120*b*, 120*c* and/or a system controller as described above with respect to FIG. 2. Each drive unit 120*a*, 120*b*, 120*c* is operatively connected to an associated motor segment 122*a*, 122*b*, 122*c* of the first part 116. Although not shown, car 114 will include a second part (see elements 118 of FIGS. 1 and 2) that will enable propulsion and driving of the car 114 within the lane 113.

In operation, drive units 120*a*, 120*b*, 120*c* can energize the associated motor segments 122*a*, 122*b*, 122*c* of the first part 116, respectively, to propel one or more elevator cars 114 upward within the lane 113. Alternatively, the motor segments 122*a*, 122*b*, 122*c* of the first part 116 can operate as a regenerative brake to control descent of an elevator car 114 in the lane 113 and provide current back to the drive units 120*a*, 120*b*, 120*c*, for example, to recharge an electrical system connected to the drive units 120*a*, 120*b*, 120*c*.

The drive units 120*a*, 120*b*, 120*c* are connected to and/or retained on or near the structural member 119 of the lane 113. Further, the motor segments 122*a*, 122*b*, 122*c* of the first part 116 are connected to and/or retained on or near the structural member 119 of the lane 113. Although shown with the drive unit 120*a*, 120*b*, 120*c* separate from the respective motor segments 122*a*, 122*b*, 122*c* of the first part 116, those of skill in the art will appreciate that the components may be configured as a single, integral unit, or sub-combinations thereof. To provide accurate location data and control within elevator system 110 a second system is provided.

Located on the structural member 119 may be one or more sensors 160*a*, 160*b*, 160*c* of a sensing system. The sensors 160*a*, 160*b*, 160*c* may also be located on the motor segments 122*b*, 122*c*, 122*d*, which are located on the structural member 119. As shown, the sensors 160*a*, 160*b*, 160*c* are on an opposite side of the lane 113 from respective, laterally adjacent drive units 120*a*, 120*b*, 120*c* and motor segments 122*a*, 122*b*, 122*c* of the first part 116. However, this is not a limiting example but rather shown for ease of explanation, and those skilled in the art will appreciate that other configurations may be used without departing from the scope of the present disclosure. For example, the sensors 160*a*, 160*b*, 160*c* may be on the same side of lane 113, adjacent to the respective drive units 120*a*, 120*b*, 120*c* and motor segments 122*a*, 122*b*, 122*c* of the first part 116. Further, although shown in FIG. 3 as a single lane 113, those of skill in the art will appreciate that any number of lanes may employ sensing systems and configurations as described herein, and each lane may contain a plurality of sensors, such as an array or series of sensors. For example, each lane 113, 115, and 117 of FIG. 1 may be configured with the sensing system of FIG. 3 and may span the entire length of the lanes 113, 115, and 117.

Sensors 160*a*, 160*b*, 160*c* are configured to be in electrical and digital communication with the respective drive unit 120*a*, 120*b*, 120*c* that is adjacent to it (i.e., at the same vertical position within the building or vertical position within the lane 113). For example, as shown in FIG. 3, the drive unit 120*a* at the top of the image is configured to be in communication with the sensor 160*a* at the top of the image. Similarly, drive unit 120*b* is configured to communicate with sensor 160*b*, and drive unit 120*c* is configured to communicate with sensor 160*c*. Accordingly, the proposed configuration is a lateral communication at the same level within the lane 113. However, those of skill in the art will appreciate that other configurations may be employed without departing from the scope of the present disclosure. For example, a single drive unit may be in communication with more than one sensor, or vice versa. The communication between the drive units and the sensors, and vice versa, may be by any known means, such as a wired connection, a wireless connection, etc. The selection may be based on the needs and design of the elevator system 110 and/or the sensing system. For example, to provide a high bandwidth, and thus very quick and efficient communication between the component parts, a wired connection may be utilized.

The series or array of elevator car state sensors 160*a*, 160*b*, 160*c* are fixed to stationary points along the lane 113 and attached to the structural member 119. The car state sensors 160*a*, 160*b*, 160*c* are configured to sense or determine a state of the elevator car, such as the position, velocity, and/or acceleration of an elevator car 114 as the elevator car 114 passes by the respective car state sensor 160*a*, 160*b*, 160*c*. Thus, the location of the elevator car 114 within the lane 113 may be determined based upon the location sensed by the car state sensors 160*a*, 160*b*, 160*c*. Thus, in some embodiments, the car state sensors are always active, and the control system selects which sensors to use for making state determinations based on the particular elevator car and/or on the car state sensor positions. In alternatively embodiments, car state sensors may become active based on proximity to a car, and thus the system may determine a car state based on active sensors within lane 113, e.g., car state sensors that are activated when an elevator car is in proximity to the sensors. Further, in some embodiments, always active car state sensors may be configured to help identify and/or locate uncontrolled elevator cars.

Car state sensors, in accordance with embodiments of the present disclosure may be sensors configured to measure or determine a state space vector, which may be position, velocity, acceleration, motor magnetic angle, direction of movement, etc. When the state space vector is position, the car state sensor may directly determine the physical position or location of an elevator car. In other embodiments, the car state sensors may be configured to sense or determine the velocity of an elevator car and from this information position and/or acceleration may be derived. In other embodiments, the car state sensors may be configured to detect motor magnetic angle which is used for motor control, and from this car position, speed, and/or acceleration may be determined. However, in all embodiments, the car state sensors are configured to determine, whether directly or indirectly through derivation, at least the physical position or location of one or more elevator cars. Moreover, in some embodiments, the car state sensor(s) may be used to derive motor magnetic angle or other characteristics for motor control feedback.

As discussed above, the car state sensors 160*a*, 160*b*, 160*c* are configured to be in communication with the drive units 120*a*, 120*b*, 120*c*. In some embodiments the car state sensors 160*a*, 160*b*, 160*c* may also be, or alternatively be, in communication with a larger control system or controller and/or a computerized system that controls the ropeless elevator system such as system controller 125 or the larger central control system described above. The array of car state sensors 160*a*, 160*b*, 160*c* is configured to enable the elevator system 110 to continually determine the position of the car 114 relative to the lane 113, which may be in the form of car position data. The car position data may be incremental, such that when car 114 enters a sensing area of a new car state sensor the incremental change may be detected, i.e., moving vertically from a first car state sensor 160*a* to the next car state sensor 160*b* within the lane 113. The sensing area of each car state sensor 160*a*, 160*b*, 160*c* may be defined as the physical space substantially proximate and/or adjacent to the physical location of the respective sensor. In some embodiments the car state sensors may be configured to always be active and in other embodiments the car state sensors may be configured to be active only when an elevator car is present in the sensing range or area of the sensor, as known in the art of sensors.

When sensing, an individual car state sensor 160*a*, 160*b*, 160*c* can start an incremental position count based on the movement of the car 114. Because the position of the car state sensor 160*a*, 160*b*, 160*c* within the lane 113 is an absolute known location after learn run sequence (discussed further below), the measurement by the sensor can determine the exact location of a car 114. Further, because the position of the car 114 relative to the car state sensors 160*a*,

160*b*, 160*c* may be incremental, i.e., changing in time, the elevator system 110 can determine a speed and/or an acceleration/deceleration based on the incremental change of position of the car 114 relative to a specific car state sensor 160*a*, 160*b*, 160*c*.

Alternatively, in some embodiments the position of the elevator car 114 may be determined as an absolute location. For example, rather than relying on an incremental change of position relative to a sensor, the sensor can determine the exact location of the car 114. In this example, a data point of the elevator car position can provide a unique value associated with a position within the lane 113. In this way, both the location of the car state sensor 160*a*, 160*b*, 160*c* is absolutely known and the position of the car 114 is absolute relative to each car state sensor 160*a*, 160*b*, 160*c*.

Further, in some embodiments, the car 114 may be configured with an identification mechanism 162 such that the car state sensors 160*a*, 160*b*, 160*c* can identify the specific car 114 that is present in the sensing area. Thus, not only can the elevator system 110 determine the position, speed, direction, and acceleration of a car 114 that is in the lane 113, the elevator system 110 can also determine which specific car 114 is located at the specific location, traveling at what speed, in which direction, and the acceleration of the specific car 114. In some alternative embodiments, as will be appreciated those of skill in the art, the identification mechanism 162 may coact with an additional sensor configured for this purpose, in addition to or instead of the car state sensors 160*a*, 160*b*, 160*c*. For example, an RFID chip and sensor configuration may be employed to determine which specific elevator car is being sensed by the system.

In order to measure and/or sense an elevator car 114 portion, in some embodiments, for example as shown in FIG. 3, the position sensing system may employ a sensed element 164. Sensed element 164 may be used as a baseline, guideline, reference, and may be configured as a scale, discrete target, and/or some other type of marking/device that may be sensed or registered by the car state sensors 160*a*, 160*b*, 160*c*. In such embodiments, various technologies may be employed for sensing the presence and position of the car 114 by sensing or registering the scale 164 or a portion thereof. For example, such technologies may include, but are not limited to, IR/optical transmissive, IR/optical reflective, magnetic encoder, eddy current sensor, Hall Effect sensor, etc. The scale 164 may provide an incremental measuring wherein each box or marking of the scale 164 may indicate a particular position on the car 114, and thus a car state sensor 160*a*, 160*b*, 160*c* can determine the movement of the car 114, upward or downward, and also speed, direction, acceleration, and/or deceleration may be calculated. The scale 164 may enable the determination of absolute location when the elevator car 114 first passes or enters the sensing area of a sensor. Then, continued monitoring and/or measuring may provide incremental measurements. The incremental measurements may allow incremental quadrature wave analysis to be conducted while the car 114 is in front of or in proximity to a particular sensor, if the respective sensor is equipped to conduct an incremental quadrature wave analysis.

The scale 164 may be configured as a tape or other form of marking(s) that are configured to be read, sensed, registered, and/or detected by the car state sensors 160*a*, 160*b*, 160*c*. For example, the scale 164 may be formed from a tape or other marking, such as paint, ink, dye, physical structure, etc. on the car 114, that provides contrasting colors, shapes, indicators, etc. that are sensed, detected, or employed by the car state sensors 160*a*, 160*b*, 160*c*. These examples are merely provided for explanatory purposes and other types of markings or scales may be used without departing from the scope of the present disclosure.

Figure 4:
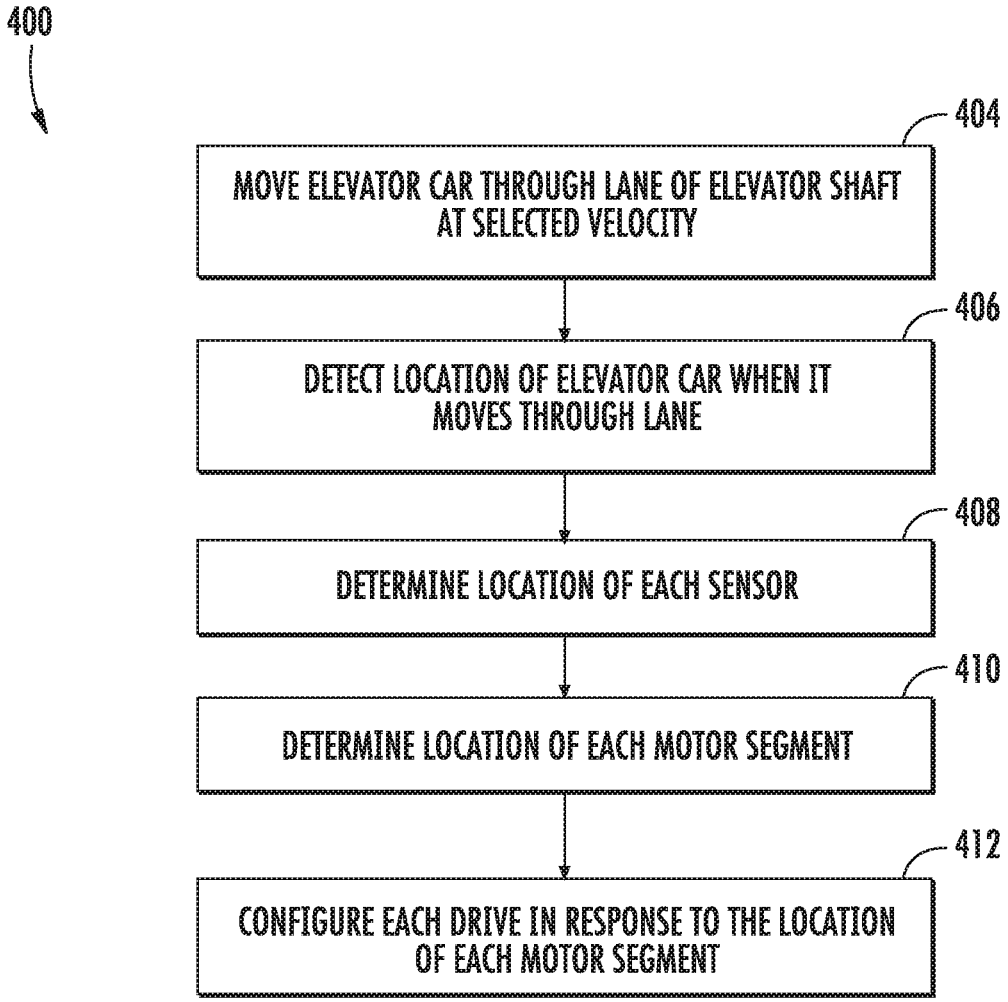
FIG. 4 is a flow diagram illustrating a method of operating the multi-car elevator system of FIG. 2-3 for a learn run sequence, according to an embodiment of the present disclosure.

Turning now to FIGS. 4-7, various embodiments of the present disclosure are provided. FIG. 4 shows a flow diagram illustrating a method 400 of operating the elevator system 110 of FIG. 2-3 for a learn run sequence, according to an embodiment of the present disclosure. As may be appreciated by one of skill in the art, the method 400 may also be applicable to single car elevator systems in addition to the multi-car elevator system discussed and illustrated. Upon first installing an elevator system 110, the car state sensors 160*a*, 160*b*, 160*c* must have locations assigned to them in the control system. These locations are the physical locations of the car state sensor 160*a*, 160*b*, 160*c* within the lanes 113, 115, 117. Further, location of the motor segments 122*a*, 122*b*, 122*c* must also be determined. Having accurate locations for the cart state sensor 160*a*, 160*b*, 160*c* and the motor segments 122*a*, 122*b*, 122*c* helps to ensure that the control system is sending the proper commands to control the operation of the elevator car 114. Once the location of the motor segments 122*a*, 122*b*, 122*c* has been determined, the associated drive 120*a*, 120*b*, 120*c* and system controller 125 also need to be configured with the motor segments 122*a*, 122*b*, 122*c* location to operate properly. The configuration helps to ensure that each motor segment 122*a*, 122*b*, 122*c* is identified properly and the corresponding drive 120*a*, 120*b*, 120*c*, receives the correct software updates.

Referring now also to FIG. 4, which shows a flow diagram illustrating a method of operating the multi-car elevator system 110 of FIG. 2-3 for a learn run sequence, according to an embodiment of the present disclosure. First off, at block 404, once the elevator system 110 has been physically installed, the linear propulsion system moves the elevator car 114 through a lane 113, 115, 117 of the elevator shaft at a selected velocity. In an embodiment, the selected velocity may be a constant velocity. As described above, the linear propulsion system allows the elevator car 114 to move through the lane 113, 115, 117. The linear propulsion system is composed of a first part 116 mounted in the lane 113, 115, 117 of the elevator shaft and a second part 118 mounted to the elevator car 114, as seen in FIG. 2. The first part 116 comprises one or more motor segments 122*a*, 122*b*, 122*c* and the second part 118 comprises one or more permanent magnets 128, as seen in FIG. 2. The second part 118 is configured to co-act with the first part to impart movement to the elevator car 114.

Figure 6:
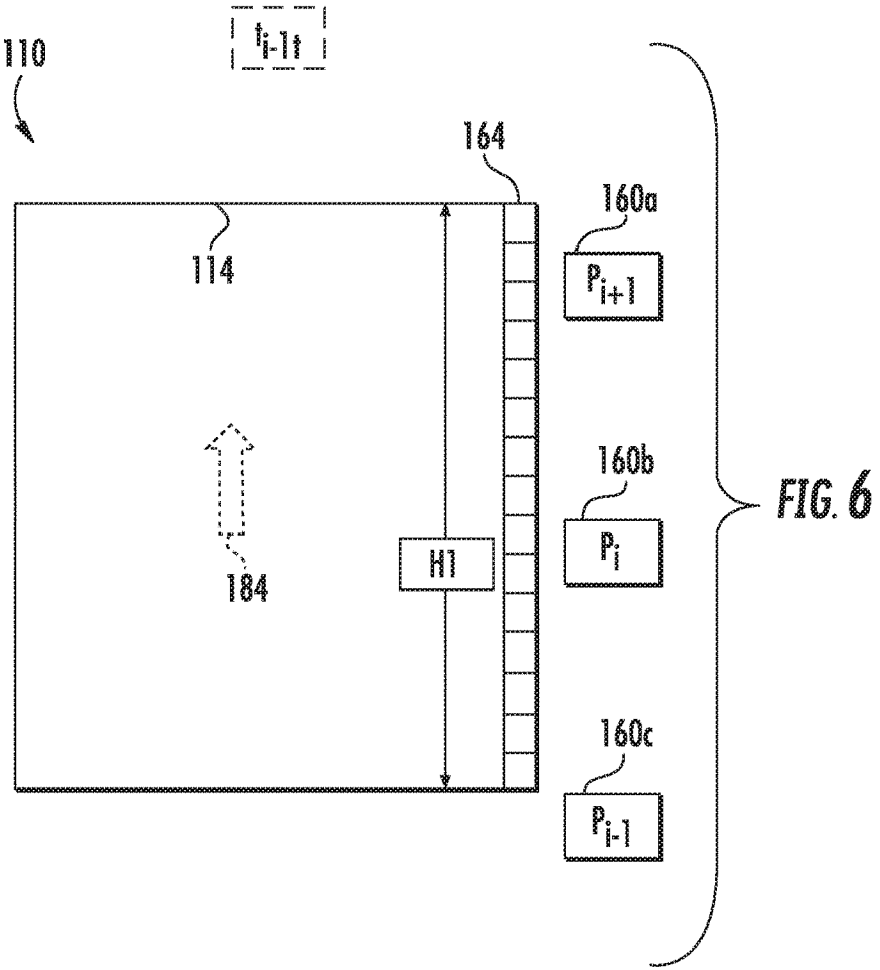
FIG. 6 illustrates an incremental sensor detection for the learn run sequence of FIG. 4, according to an embodiment of the present disclosure.
Figure 5:
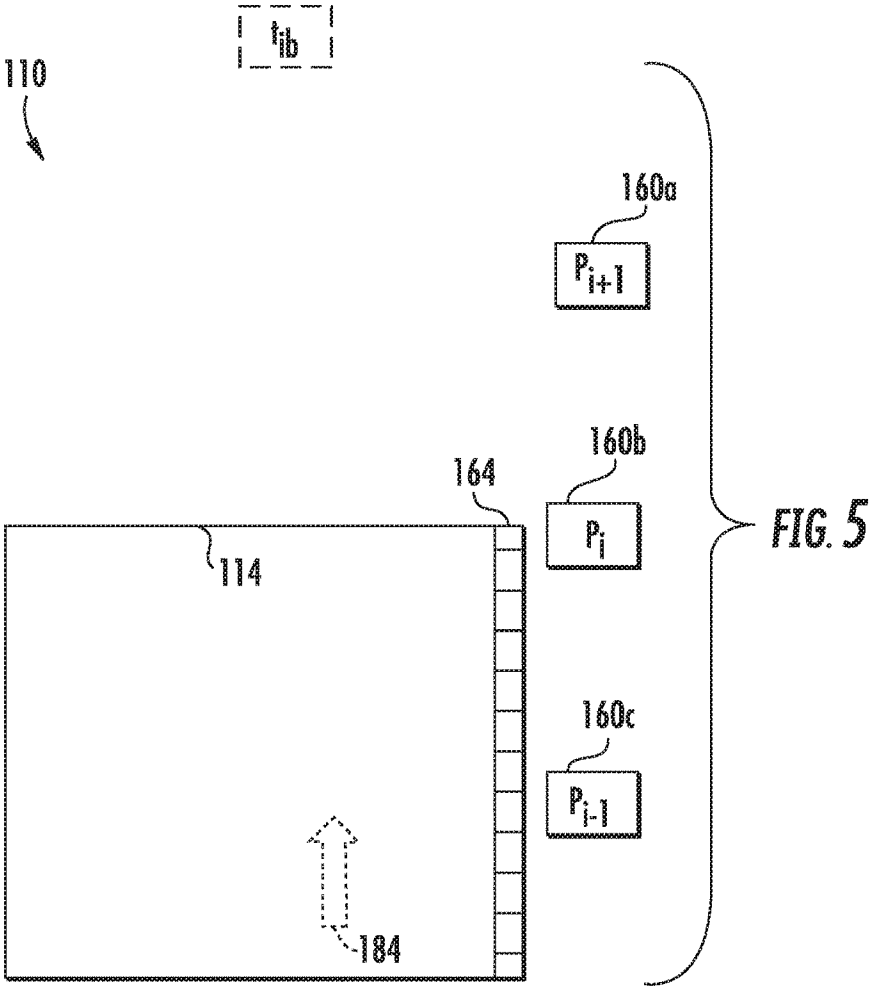
FIG. 5 illustrates an incremental sensor detection for the learn run sequence of FIG. 4, according to an embodiment of the present disclosure.

Next, at block 406, the sensor system detects the location of the elevator car 114 when it moves through the lane 113, 115, 117. The sensor system, as described above, is composed of a plurality of sensed elements 164 disposed on the elevator car 114 and a plurality of car state sensors 160*a*, 160*b*, 160*c* disposed within the lane 113, 115, 117 as seen in FIG. 3. Then at block 408, the control system determines at least one of a location of each of the car state sensors 160*a*, 160*b*, 160*c* relative to each other within the lane in response to a travel time of the elevator car 114, a velocity of the elevator car 114, a position of the elevator car 114 and a height H1 of the elevator car 114. FIGS. 5 and 6 show an example of how an incremental sensor detection system may work to detect the location of car state sensors 160*a*, 160*b*, 160*c*. As shown in FIG. 5, at time $t_{ib}$ the top of elevator 114 has reached sensor 160*b*. The position reported by each car state sensor 160*a*, 160*b*, 160*c* is measured and then the position is cross referenced at selected time instants to calculate a distance $dp_i$, which is a distance between two car state sensors 160*a*, 160*b*, 160*c*. Thus, in a non-limiting embodiment, the location $p_i$ of car state sensors 160*b* relative to car state sensors 160*c* at location $p_{i-1}$ may be expressed by the equation $p_i=p_{i-1}+dp_i$. Further, as shown in FIG. 6, at time $t_{i-1t}$ the bottom of the elevator has now moved past car state sensors 160*c* at location $p_{i-1}$ and the control system may now calculate: $p_{i-1}+H1=+dp_{i-1}$. In a non-limiting embodiment, an average may be used for an improved estimate, as shown the following equation: $p_i-p_{i-1}=(dp_i+H1-dp_{i-1})/2$.

Figure 7:
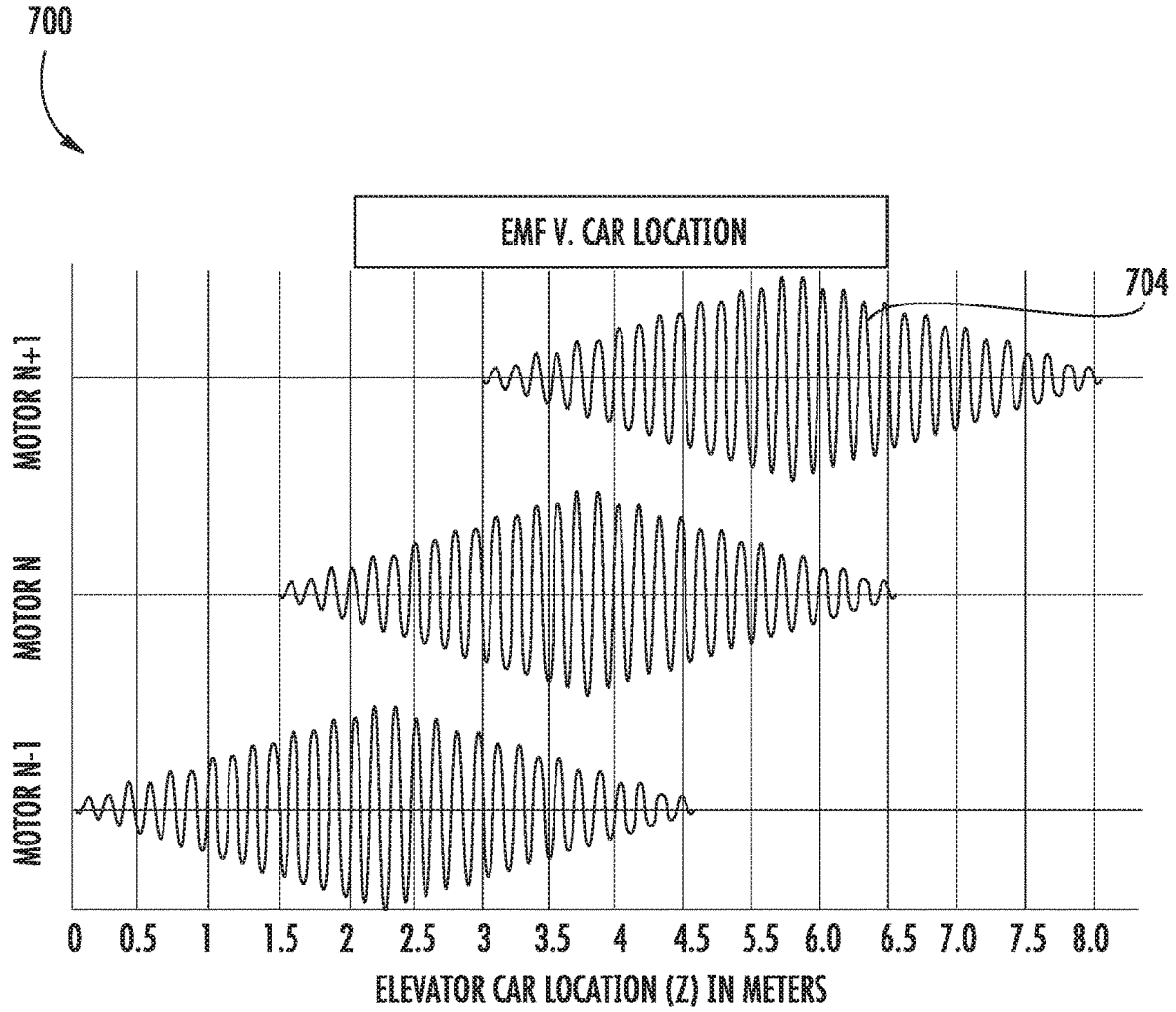
FIG. 7 is a graph displacing a back electromotive force versus an elevator car location for various drive motor segments of the elevator system of FIGS. 1-3, according to an embodiment of the present disclosure.

Next, at block 410 the control system determines at least one of the location, the length, and the phasing each of the motor segments 122*a*, 122*b*, 122*c* in response to back electromotive force (EMF) of the motor segments 122*a*, 122*b*, 122*c*. FIG. 7 shows how the EMF various drive motor segments of the motor segments 122*a*(N−1), 122*b*(N), 122*c* (N+1) may change as the elevator car 114 moves past each motor segment 122*a*, 122*b*, 122*c*. As the elevator car 114 moves at a selected velocity, the drives 120*a*, 120*b*, 120*c* corresponding to motor segments 122*a*, 122*b*, 122*c* are configured to monitor current and/or voltage. The position and velocity of the elevator car 114 is also measured and broadcasted to the each drives 120*a*, 120*b*, 120*c* and the control system. The control system and/or drives 120*a*, 120*b*, 120*c* will identify key transitions in their current/voltage waveforms 704 and use these transitions to calculate location and length of each of the motor segments 122*a*, 122*b*, 122*c*. The back EMF increases as the elevator car 114 nears the motor segment 122*a*, 122*b*, 122*c* as seen by the peaks in the waveforms 704 in FIG. 7. The number and/or frequency of peaks in the waveforms 704 of FIG. 7 may be used to determine the number and pitch of poles in the motor segments 122*a*, 122*b*, 122*c* in response to the velocity of the elevator 114. The motor segments 122*a*, 122*b*, 122*c* and/or the controller may calculate the phasing of each motor segment in response to the sequence of peaks in the waveforms 704 and direction of movement of the elevator car 114. In an embodiment, the EMF data may be shared and cross-referenced between each of the motor segments 122*a*, 122*b*, 122*c*. Advantageously, sharing and cross-referencing will provide added consistency and/or accuracy.

Finally, at block 412, each drive 120*a*, 120*b*, 120*c* is configured in response to the location of the respective motor segment 122*a*, 122*b*, 122*c*. The configuration process may be performed by a configuration system 170 operably connected to the elevator system 110. The configuration system 170 may assign each drives 120*a*, 120*b*, 120*c* an address dynamically through an assignment process, such as, for example, a dynamic host configuration protocol (DHCP). The drives 120*a*, 120*b*, 120*c* may be discovered during the configured by getting the data from the DHCP or scanning for available drives 120*a*, 120*b*, 120*c* using a method, such as, for example address resolution protocol (ARP), ping, and zeroconf. The configuration system cross references the address of drive 120*a*, 120*b*, 120*c* with the location in the lane 113, 115, 117 of each motor segment 122*a*, 122*b*, 122*c* and sends the appropriate set of parameters to operate to each motor segment 122*a*, 122*b*, 122*c*.

Advantageously, embodiments of the present disclosure provide information that enables the elevator system to actively and precisely locate the sensors and motor segments in a multicar, ropeless elevator system. Further advantageously, embodiments of the present disclosure provide information that enables the elevator system to actively configure the motor segments.

The terminology used herein is for the purpose of describing particular embodiments only and is not intended to be limiting. While the description has been presented for purposes of illustration and description, it is not intended to be exhaustive or limited to embodiments in the form disclosed. Many modifications, variations, alterations, substitutions or equivalent arrangement not hereto described will be apparent to those of ordinary skill in the art without departing from the scope of the disclosure. Additionally, while the various embodiments have been described, it is to be understood that aspects may include only some of the described embodiments. Accordingly, the disclosure is not to be seen as limited by the foregoing description, but is only limited by the scope of the appended claims.

What is claimed is:

1. A method of operating an elevator system for a learn run sequence, the method comprising:

moving, using a linear propulsion system, a first elevator car through a first lane of an elevator shaft at a selected velocity by co-acting a first part mounted in the elevator lane with a second part mounted to the elevator car;

detecting, using a sensor system, a location of the first elevator car when it moves through the lane by detecting a plurality of sensed elements disposed on the elevator car using a plurality of car state sensors disposed within the lane;

controlling, using a control system, the first elevator car; and determining, using the control system, a location of each of the plurality of car state sensors relative to each other within the first lane in response to at least one of a travel time of the first elevator car, a velocity of the first elevator car, a position of the first elevator car, and a height of the first elevator car.

2. The method of claim 1, further comprising:

determining, using the control system, at least one of a location, a length, and a phasing of one or more motor segments mounted in the first lane of the elevator shaft in response to a back electromotive force of the one or more motor segments.

3. The method of claim 2, further comprising:

configuring one or more associated drives of the one or more motor segments in response to the location of the one or more motor segments.

4. The method of claim 1, further comprising:

determining, using the plurality of car state sensors, a location of the first elevator car and a second elevator car disposed in the first lane of the elevator shaft.

5. The method of claim 1, wherein:

determining, using the plurality of car state sensors, a location of a second elevator car disposed in a second lane of the elevator shaft.

6. An elevator system comprising:

a linear propulsion system configured to move a first elevator car through a first lane of an elevator shaft at a selected velocity, the linear propulsion system comprising:

a first part mounted in the first lane of the elevator shaft; and a second part mounted to the first elevator car, the second part being configured to co-act with the first part to impart movement to the first elevator car;

a sensor system configured to detect a location of the first elevator car when it moves through the first lane, the sensor system comprising;

a plurality of sensed elements disposed on the first elevator car; and a plurality of car state sensors disposed within the first lane, the plurality of car state sensors being configured to detect the sensed element when the first elevator car is in proximity to the respective car state sensor;

a control system configured to control the first elevator car, the control system being in operable communication with the first elevator car, the linear propulsion system, and the sensor system, wherein the control system is configured to determine a location of each of the plurality of car state sensors relative to each other within the first lane in response to at least one of a travel time of the first elevator car, a velocity of the first elevator car, a position of the first elevator car, and a height of the first elevator car.

7. The elevator system of claim 6, wherein:

the first part comprises one or more motor segments and one or more associated drives; and the second part comprises one or more permanent magnets.

8. The elevator system of claim 7, wherein the control system is configured to determine at least one of a location, a length, and a phasing of each of the one or more motor segments in response to a back electromotive force of the one or more motor segments.

9. The elevator system of claim 8, wherein each of the one or more associated drives is configured in response to the location of the one or more motor segments.

10. The elevator system of claim 6, further comprising a second elevator car disposed in the first lane of the elevator shaft as the first elevator car, wherein the plurality of car state sensors are configured to determine a location of the first elevator car and the second elevator car.

11. The elevator system of claim 6, wherein:

the plurality of car state sensors define a plurality of first car state sensors disposed with a first lane, the elevator system further comprising:

a second elevator car disposed in a second lane of the elevator shaft; and a plurality of second car state sensors disposed within the second lane configured to determine a location of the second elevator car.

12. A computer program product tangibly embodied on a computer readable medium, the computer program product including instructions that, when executed by a processor, cause the processor to perform operations comprising:

moving, using a linear propulsion system, a first elevator car through a first lane of an elevator shaft at a selected velocity by co-acting a first part mounted in the elevator lane with a second part mounted to the elevator car;

detecting, using a sensor system, a location of the first elevator car when it moves through the lane by detecting a plurality of sensed elements disposed on the elevator car using a plurality of car state sensors disposed within the lane;

controlling, using a control system, the first elevator car; and determining, using the control system, a location of each of a plurality of car state sensors relative to each other within the first lane in response to a travel time of the first elevator car, a velocity of the first elevator car, a position of the first elevator car, and a height of the first elevator car.

13. The computer program product of claim 12, wherein the operations further comprise:

determining, using the control system, at least one of a location, a length, and a phasing of one or more motor segments mounted in the first lane of the elevator shaft one or more motor segments in response to a back electromotive force of the one or more motor segments.

14. The computer program product of claim 13, wherein the operations further comprise:

configuring one or more associated drives of the one or more motor segments in response to the location of the motor segment.

15. The computer program product of claim 12, wherein:

determining, using a plurality of car state sensors, a location of the first elevator car and a second elevator car disposed in the first lane of the elevator shaft.

16. The computer program product of claim 12, wherein:

determining, using the plurality of car state sensors, a location of a second elevator car disposed in a second lane of the elevator shaft.

* * * * *